United States Patent [19]

Fischer

[11] Patent Number: 4,716,807

[45] Date of Patent: Jan. 5, 1988

[54] SPEED CONTROL APPARATUS AND METHOD FOR BRAIDING MACHINE

[75] Inventor: Thomas A. Fischer, Orangeburg, S.C.

[73] Assignee: Mayer Wildman Industries, Inc., Orangeburg, S.C.

[21] Appl. No.: 942,676

[22] Filed: Dec. 17, 1986

[51] Int. Cl.[4] ..... D04C 3/06; D04C 1/00; D04C 3/12; D04C 3/40

[52] U.S. Cl. ..... 87/20; 87/15; 87/29; 87/33; 87/44; 87/50

[58] Field of Search ..... 87/14, 15, 18–22, 87/29, 31, 33, 41, 44–48, 55–57, 50, 51

[56] References Cited

U.S. PATENT DOCUMENTS

| | | | |
|---|---|---|---|
| 3,408,894 | 11/1968 | Kaufmann et al. | 87/50 X |
| 3,642,016 | 2/1972 | Budzich et al. | 87/20 |
| 3,783,736 | 1/1974 | Richardson | 87/29 |
| 4,266,461 | 5/1981 | Moliton | 87/20 X |

*Primary Examiner*—John Petrakes
*Attorney, Agent, or Firm*—Bell, Seltzer, Park & Gibson

[57] ABSTRACT

The present speed control apparatus and method operates to progressively increase the speed of travel of the strand supply carrier shuttles of the braiding machine as the amount of strand material wound on the supply carriers is decreased and to thereby increase the efficiency of the braiding machine. The speed control includes an ultrasonic sensor supported adjacent the path of travel of the strand supply carrier shuttles and being operable to detect the amount of strand material remaining on the strand supply carriers during each serpentine path of travel of the strand supply carriers past the sensor. Computers are provided for progressively increasing the speed of travel of the strand supply carrier shuttles in response to detected decreases in the amount of strand material on the strand supply carriers.

13 Claims, 9 Drawing Figures

SPEED CONTROL APPARATUS AND METHOD FOR BRAIDING MACHINE

FIELD OF THE INVENTION

This invention relates generally to a speed control apparatus and method for a maypole type braider and more particularly to a speed control which is operable to progressively increase the speed of operation of the braider as the amount of strand material wound on the strand supply carriers is decreased and to thereby operate the machine at the optimum speed and increase the efficiency of the braiding machine.

BACKGROUND OF THE INVENTION

Maypole type braiders have been utilized for many years in forming single or multiple braided covers on various types of core materials, such as plastic tubing and the like. Generally, this conventional type of braiding machine is provided with a set of drive rotors rotatably supported in a circular arrangement around a central braiding location. First and second sets of strand supply carrier shuttles are moved in serpentine intersecting paths of travel and in opposite directions around the drive rotors and the central braiding location so that the strand material wound on the strand supply carriers is withdrawn therefrom and forms the braided cover. Examples of this conventional type of braiding machine are illustrated in U.S. Pat. Nos. 3,408,894 and 3,783,736.

The strand supply carrier shuttles are held in engagement with the drive rotors and transferred from one drive rotor to an adjacent drive rotor by means of bearing supported cam followers carried by the drive rotors and engageable with cam tracks on a cam wheel carried by each of the strand supply carrier shuttles. The maximum speed at which the braider can operate, without imparting excessive wear to the cam follower support bearings, is determined by the initial weight of the strand material wound on the strand supply carriers. It is the conventional practice to set the maximum operating speed of the braider in accordance with the type of strand material which is wound on the strand supply carriers and to continuously maintain this same maximum speed of operation throughout the braiding operation, even though the weight of the strand material wound on the strand supply carriers is progressively decreased as the strand material is unwound from the strand supply carriers, so that the maximum efficiency of the braiding machine is not utilized.

SUMMARY OF THE INVENTION

With the foregoing in mind, it is an object of the present invention to provide a speed control and method for a braider which operates to progressively increase the speed of operation of the braider as the amount and weight of strand material on the strand supply carriers is decreased and to thereby operate the machine at the optimum speed and increase the efficiency of the braiding machine.

In accordance with the present invention, the speed control includes sensor means supported adjacent the path of travel of the strand supply carriers and being operable to detect the amount of strand material remaining on the strand supply carriers during selected serpentine paths of travel of the strand supply carriers during the braiding operation. Control means is operative by the sensor means and is operable to progressively increase the speed of travel of the strand supply carrier shuttles in response to progressive decreases in the amount of strand material wound on the strand supply carrier shuttles.

Preferably, the sensor means includes a pair of ultrasonic detectors positioned adjacent side-by-side drive rotors and with one of the ultrasonic detectors being operable to detect the amount of strand material remaining on each of a first set of strand supply carriers while the other ultrasonic detector is operable to detect the amount of strand material remaining on each of a second set of strand supply carriers. Noncontact type proximity switches are also supported adjacent each of the ultrasonic detectors and operate to trigger the ultrasonic detectors at the precise time that the strand supply carriers are properly aligned to detect the amount of strand material remaining thereon.

The braiding machine may include a single deck or multiple decks with each of the decks being provided with sixteen, twenty or twenty-four strand supply carrier shuttles. A haul-off unit is provided in alignment with the last deck of the braiding machine for withdrawing the braided product in timed relationship to the operation of the braiding decks. A drive motor is provided for the haul-off unit and includes an eddy current variable speed clutch drivingly connected to a main drive shaft extending to and driving each of the braiding decks. It is preferred that each of the braiding decks be provided with proximity switches and ultrasonic sensors and a minicomputer. A master computer is operatively connected to each of the minicomputers and is programmed to gradually and progressively increase the speed of rotation of the main drive shaft as the amount of strand material wound on the strand supply carriers is gradually decreased. The master computer is provided with a program which includes speed curves calculated in accordance with the type of strand material on the strand supply carriers. For example, it has been found that the particular type of braider illustrated can operate without excessive bearing wear at a maximum speed of 235 revolutions per minute of the drive rotors when yarn is wound on the strand supply carriers, and at a maximum speed of 225 revolutions per minute when wire is wound on the strand supply carriers. By gradually increasing the operating speed of the braider as the amount of strand material on the strand supply carrier shuttles is decreased, it is possible to gradually increase the speed of the drive rotors to 275 revolutions per minute when wire is wound on the strand supply carrier shuttles so that the average speed increase of the braider is 14 percent, thereby increasing the efficiency of the braider.

In certain instances, such as when the strand material is improperly wound on a supply package, it may be necessary to replace one or more of the partly used supply packages with full supply packages while the remaining partly used supply packages remain on the machine. In this circumstance, the sensor means of the present speed control will detect the presence of any full supply packages and will automatically adjust the operating speed to the reduced proper speed to prevent excessive wear on the cam follower support bearings associated with the full supply packages.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
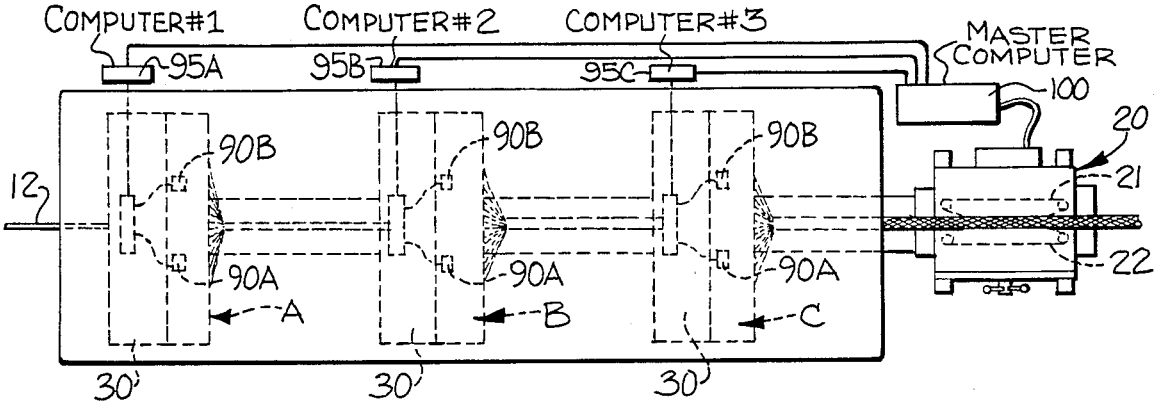
FIG. 1 is a plan view of a three deck braiding machine with the speed control of the present invention applied thereto.

The braiding machine illustrated in the drawings is of the type currently being manufactured and sold by Mayer Wildman Industries as Model No. MR-11 BRAIDMATIC (trademark) and the haul-off device is of the type currently being manufactured and sold by Mayer Wildman Industries as Model No. MC-2. However, it is to be understood that the speed control of the present invention may also be applied to other maypole type braiders and will operate to gradually and progressively increase the speed of the braider as the amount of strand material wound on the strand supply carrier shuttles is decreased to thereby increase the efficiency of the braiding machine, without causing excessive wear of the bearing supported cam followers which maintain the strand supply carrier shuttles in position on the drive rotors.

Figure 2:
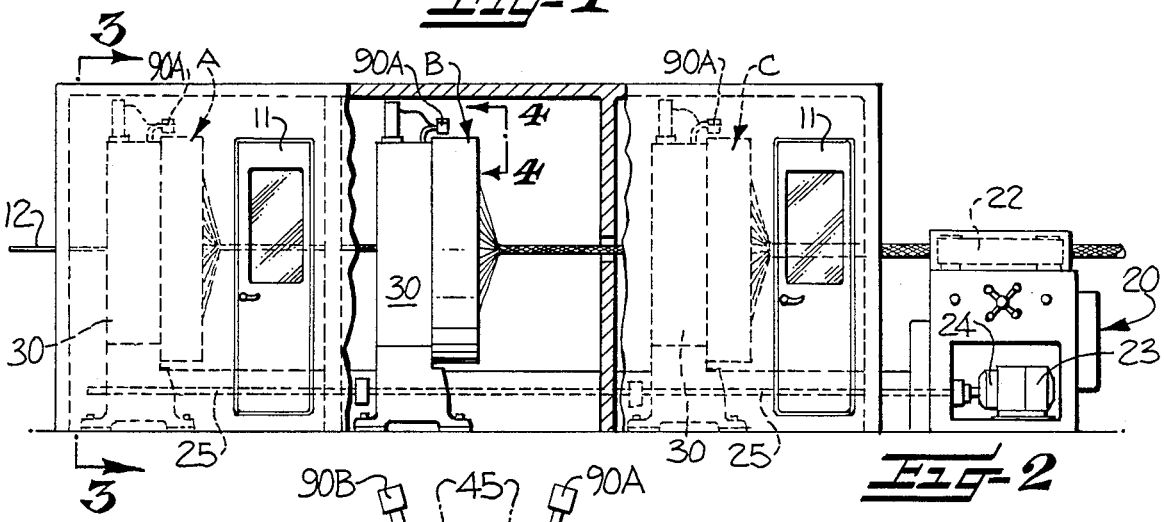
FIG. 2 is a side elevational view of the braiding machine shown in FIG. 1 and with the side wall of the central acoustical enclosure being broken away.

Each deck, broadly indicated respectively at A, B and C in FIGS. 1 and 2, is located in an acoustical enclosure 10 provided with an access door 11 (FIG. 2) so that the operator can enter the enclosure 10 for making repairs, changing strand supply carriers and the like. A hose or other suitable type of core element 12 is guided into the central braiding location and passes through each of the braiding decks A, B and C where successive braided covers are applied thereto. The covered hose is then withdrawn under the proper amount of tension and at the required speed by the haul-off unit, broadly indicated at 20. A pair of caterpillar type tracks 21, 22 (FIG. 1) engage opposite sides of the covered hose and direct the same to a suitable take-up reel or the like, not shown. Movement is imparted to the tracks 21, 22 by means of a main drive motor 23 (FIG. 2) which is provided with an eddy current variable speed clutch 24, for purposes to be presently described. A main drive shaft 25 is drivingly connected at one end to the variable speed clutch 24 and extends to and is drivingly connected to each of the braiding decks A, B and C.

Figure 3:
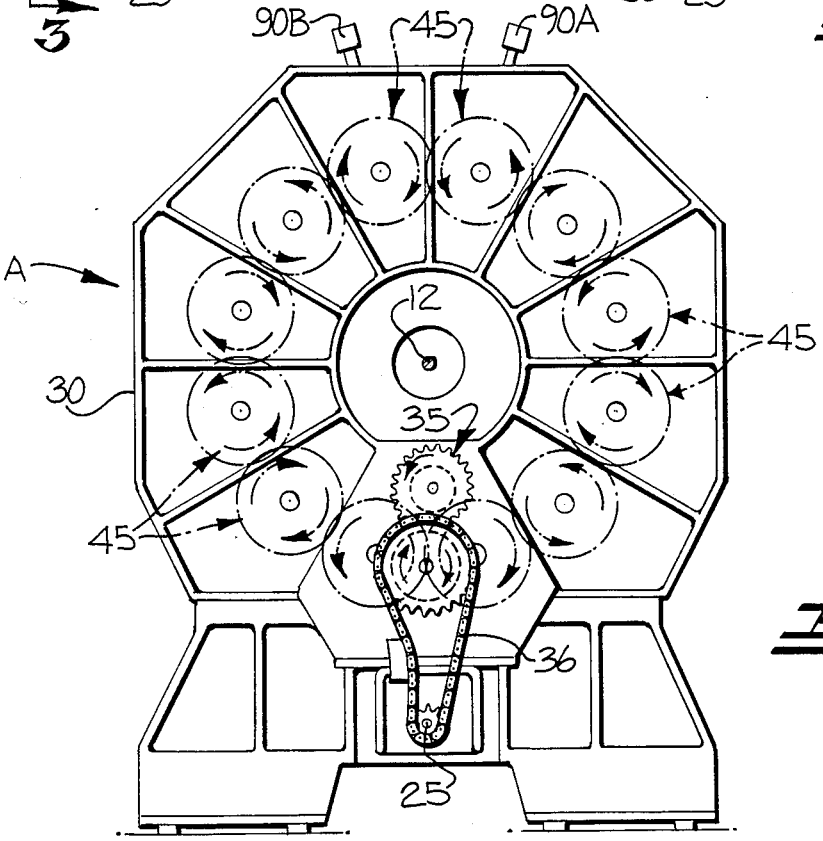
FIG. 3 is an enlarged rear elevational view of one deck of the braiding machine, being taken substantially along the line 3—3 in FIG. 2 and omitting the acoustical enclosure.

As illustrated in FIG. 3, each of the braiding decks includes a vertically extending main frame 30 and the main drive shaft 25 extends through the lower portion thereof. The main drive shaft 25 is drivingly connected to a set of speed change gears, broadly indicated at 35, by means of a drive chain 36. The speed change gears 35 impart rotation to main drive gears 40 which are each fixed to corresponding drive rotors, broadly indicated at 45, and shown in phantom lines in a circular arrangement around the central braiding location in FIG. 3. The drive rotors 45 are supported for rotation on the forward end portions of stub shafts 46, the rear portions of which are fixed on the frame 30 by bearing blocks 47 (FIG. 5).

Figure 4:
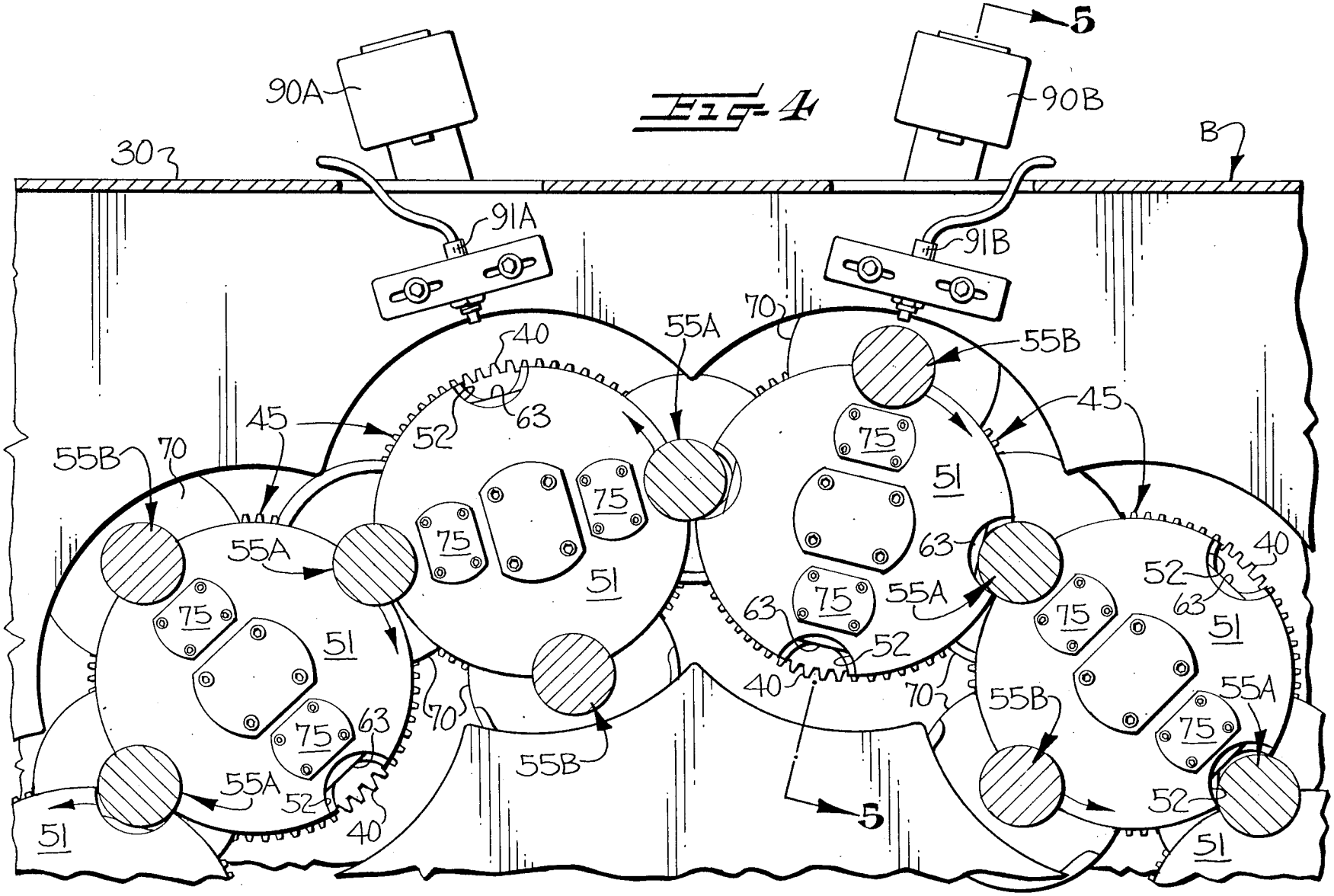
FIG. 4 is an enlarged fragmentary vertical sectional view, being taken substantially along the line 4—4 in FIG. 2, and illustrating the location of the sensors and proximity switches relative to the serpentine intersecting paths of travel of the strand supply carrier shuttles.
Figure 7:
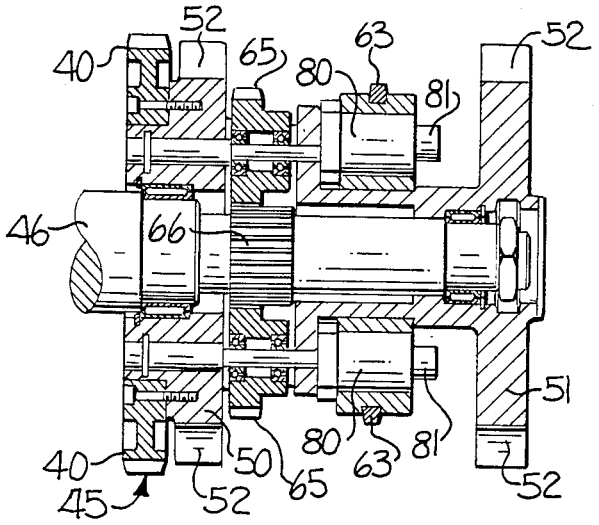
FIG. 7 is a vertical sectional view through one of the drive rotors and illustrating the rear set of bearings and cam followers supported thereby.
Figure 8:
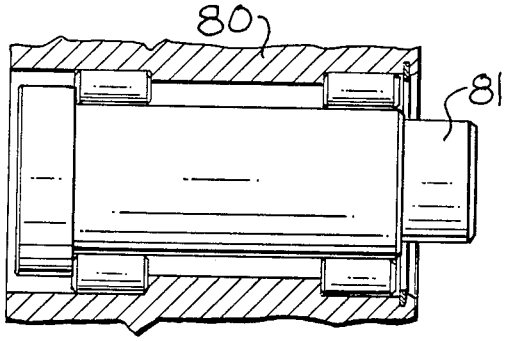
FIG. 8 is an enlarged sectional view of one of the rear bearings and cam followers shown in FIG. 7.
Figure 9:
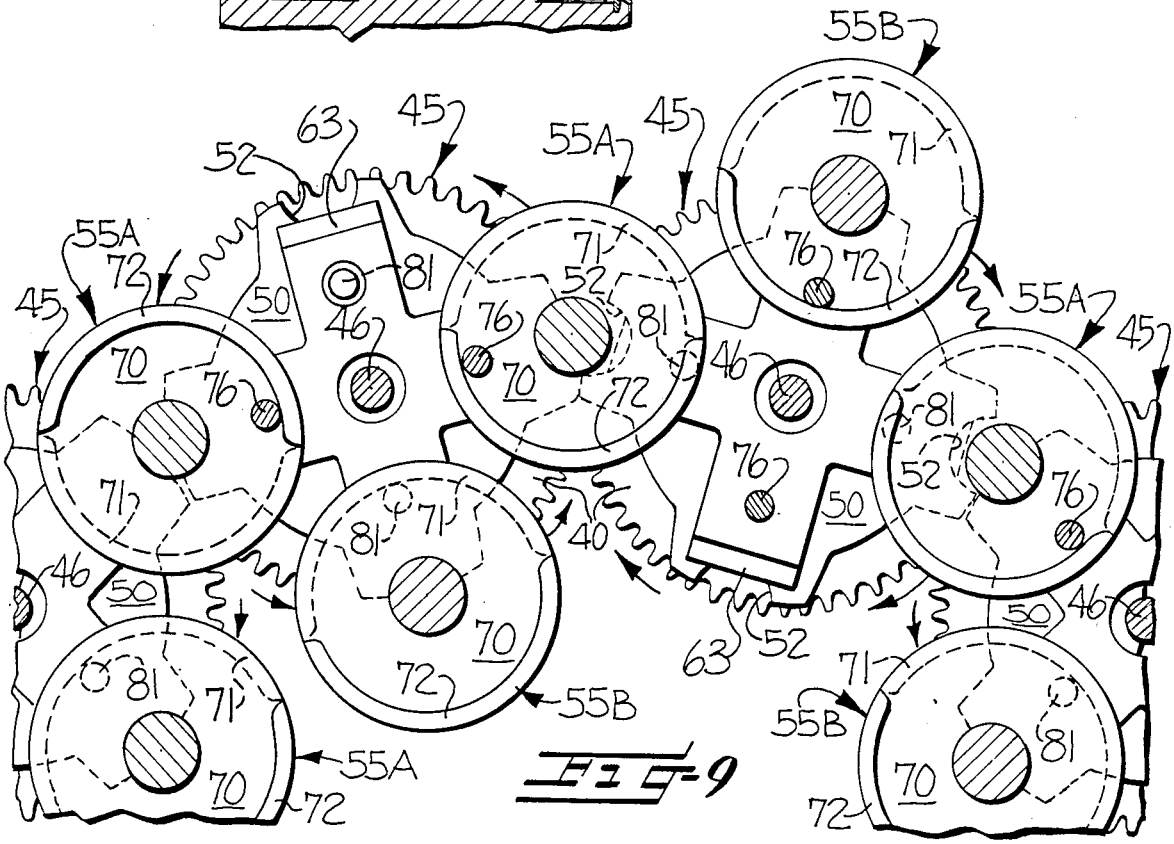
FIG. 9 is a somewhat schematic fragmentary vertical sectional view, being taken substantially along the line 9—9 in FIG. 5 and illustrating the manner in which the first and second sets of strand supply carrier shuttles move in serpentine intersecting paths of travel and in opposite directions around the central braiding location.

Each of the drive rotors 45 is provided with respective rear and front drive rotor disks 50, 51 (FIG. 7) which are drivingly connected to the drive gear 40 and include four equally spaced semicircular shuttle support notches 52 for receiving and rotatably supporting spaced-apart portions of the strand supply carrier shuttles. Respective first and second sets of strand supply carrier shuttles, broadly indicated at 55A and 55B, are supported by the drive rotors 45 and are moved along serpentine intersecting paths of travel in opposite directions around the central braiding location, as illustrated in FIGS. 4 and 9. As illustrated in these figures, the first set of strand supply carrier shuttles 55A moves in a serpentine path of travel and in a counterclockwise direction around the central braiding location while the second set of strand supply carrier shuttles 55B moves along a serpentine path of travel and in a clockwise direction.

Figure 5:
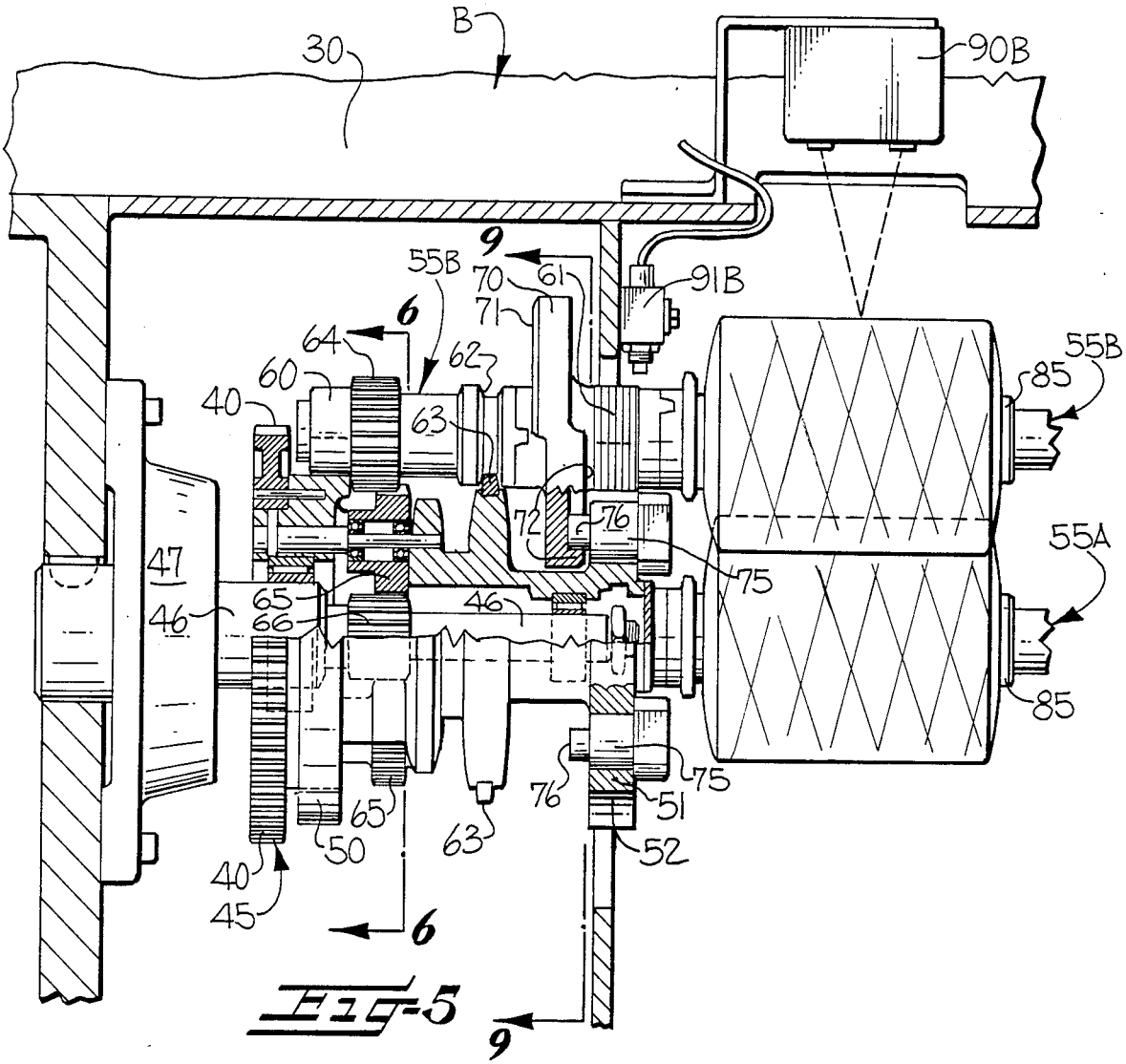
FIG. 5 is a vertical sectional view taken substantially along the line 5—5 in FIG. 4.

As best illustrated in the upper portion of FIG. 5, each of the strand supply carrier shuttles 55A and 55B includes a rear bearing portion 60 adapted to seat in the semicircular bearing notches 52 in the rear rotor disk 50, and a front bearing portion 61 adapted to seat in the semicircular bearing notches 52 in the front rotor disk 51. A grooved collar 62 is provided intermediate the bearing portions 60, 61 for engagement with a locking key 63 fixed on a hub of the drive rotor 45 and positioned between the rear rotor disk 50 and the front rotor disk 51. Engagement of the key 63 with the grooved collar 62 prevents movement of the strand supply carrier shuttles 55A, 55B in a direction along the longitudinal rotational axis thereof.

Figure 6:
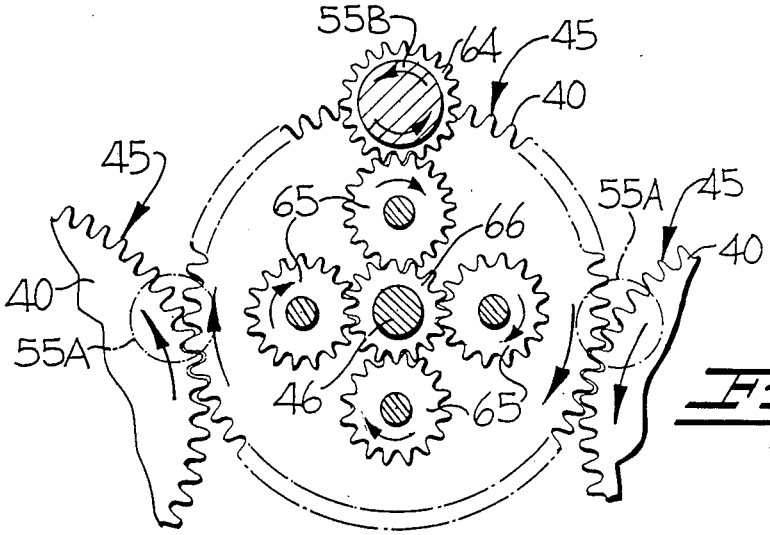
FIG. 6 is a vertical sectional view taken along the line 6—6 in FIG. 5 and illustrating the manner in which adjacent drive rotors are drivingly interconnected, and the planetary gear arrangement for imparting rotation to the strand supply carrier shuttles.

A drive pinion 64 is fixed on the shaft of the strand supply carrier shuttle and adjacent the rear bearing portion 60 (FIGS. 5 and 6). The pinion 64 is drivingly engaged with a series of planetary gears 65 supported for rotation on the main drive gear 40 and which drivingly engage a sun gear 66 mounted on the stub shaft 46.

A cam wheel 70 is fixed on each of the strand supply carrier shuttles 55A and 55B and is provided with respective rearwardly facing and forward facing semicircular cam tracks 71, 72. Front bearings 75 (FIG. 5) are fixed in the front rotor disk 51 and rotatably support cam followers 76 which are adapted to engage the forward facing cam track 72 of the cam wheel 70. Rear bearings 80 (FIG. 7) are supported in bearing arms on the drive rotors 45 and rotatably support cam followers 81 which are adapted to engage the rearwardly facing cam track 71 of the cam wheel 70. As illustrated in FIG. 9, the cam tracks 71, 72, engaging the respective cam followers 81, 76, maintain the strand supply carrier shuttles 55A, 55B in the notches 52 in the rear and front rotor disks 50, 51 as the drive rotors 45 are rotated. These bearings 75, 80 are subjected to excessive wear if the braiding machine is operated at a higher speed than that for which it was designed. This is due to the cantilever position of the strand supply and the limited bearing support due to the spindle transfer requirement.

The maximum speed at which the braider can be operated is dependent primarily upon the type and amount of strand material which is wound on strand supply carriers 85 (FIG. 5) supported on the forward end of the strand supply carrier shuttles 55A and 55B. For example, the drive rotors 45 can be rotated at a maximum speed of 235 revolutions per minute when a package of yarn weighing approximately seven pounds is provided on the strand supply carrier 85. On the other hand, the drive rotors 45 can be rotated a maximum of 225 revolutions per minute when a package of wire weighing approximately twenty pounds is provided on the strand supply carrier 85. It is the normal practice to operate the braiding machine continuously at this maximum speed from the time that the braiding operation initially starts, with the strand supply carriers 85 being filled with strand material, until all of the strand material is unwound from the strand supply carriers 85.

In contrast to this normal operation of continuously operating the braider at a constant speed, the speed control of the present invention includes sensor means for detecting the actual amount of strand material remaining on the supply carriers during successive rotations as the braiding continues, and control means operative by the sensor means and being operable to progressively increase the speed of travel of the strand supply carrier shuttles in response to a detected decrease in the amount of strand material wound on the strand supply carriers. Thus, the operation of the braiding machine, with the present speed control applied thereto, results in the machine beginning the braiding operation at the maximum speed permitted with full strand supply carriers and then gradually increasing the operating speed up to and sometimes in excess of 275 revolutions per minute, for example, of the drive rotors 45 when the strand supply is substantially exhausted on the strand supply carriers 85.

The speed control of the present invention operates to progressively increase the speed of travel of the first and second sets of strand supply carrier shuttles 55A and 55B as the amount of strand material wound on the strand supply carriers 85 is decreased and to thereby increase the efficiency of the braiding machine by an average of approximately 14 percent. The speed control includes sensor means supported adjacent the path of travel of the strand supply carrier shuttles 55A and 55B and being operable to detect the amount of strand material remaining on the strand supply carriers 85 during selected serpentine paths of travel of the first and second sets of strand supply carrier shuttles 55A and 55B during the braiding operation. The present speed control means also includes control means which is operative by the sensor means and is operable to progressively increase the speed of travel of the first and second sets of strand supply carrier shuttles 55A, 55B in response to a decrease in the amount of strand material wound on the strand supply carriers 85.

More specifically, the speed control means of the present invention includes a first ultrasonic detector 90A supported on the upper portion of the frame 30 of each deck A–C of the braiding machine and adjacent the path of travel of the strand supply carriers 85 supported by the first set of strand supply carrier shuttles 55A (FIG. 4). A second ultrasonic detector 90B is supported on the upper portion of the frame 30 and adjacent the path of travel of the strand supply carriers 85 being carried by the second set of strand supply carrier shuttles 55B as they pass along the serpentine path of travel and around the upper peripheral portion of the right-hand drive rotor 45, as shown in FIG. 4.

While there is a wide range of commercially available sensors available, it has been found that a satisfactory sensor is the Model E-201 Ultrasonic Ranging Module manufactured by Massa Products Corporation. These sensors, 90A and 90B, are each provided with a transmitting transducer and a receiving transducer with an interface electronic module and a narrow beam acoustic pulse is transmitted to very precisely detect the diameter of each strand supply carrier 85 as it passes thereby. This size information is transmitted to a corresponding minicomputer, to which the sensors 90A, 90B are connected.

A first inductive proximity switch 91A (FIG. 4) is also supported on the frame 30 and adjacent the path of travel of the first set of strand supply carrier shuttles 55A. A second inductive proximity switch 91B is also supported on the frame 30 and is positioned to detect the presence of the rear bearing portion 61 of the strand supply carrier shuttles 55B as they pass thereby (FIG. 5). The proximity switches 91A, 91B are provided to accurately trigger the detectors 90A, 90B and to thereby accurately detect the amount of strand material remaining on the strand supply carriers 85 as they pass thereby in their successive serpentine paths of travel around the central braiding location. There are numerous types of proximity switches which are currently available and which may be used. It has been found that one currently available proximity switch is operable in the present invention and this proximity switch is manufactured by Veeder-Root Digital Systems as their Model NPN 5-30VDC.

As has been mentioned, the sensors 90A, 90B accurately monitor the amount of strand material remaining on the strand supply carriers 85 as they move past the detectors and this information is fed into respective minicomputers 95A, 95B and 95C associated with each of the respective braiding decks A–C, as schematically illustrated in FIG. 1. These minicomputers are connected to a master computer 100 which is electronically connected to and controls the output speed of the eddy current variable speed clutch 24 and to thereby progressively increase the speed of rotation of the main drive shaft 25. Thus, the speed of travel of the first and second sets of strand supply carrier shuttles 55A, 55B is progressively increased in response to a detected decrease in the amount of strand material wound on the strand supply carriers 85.

While the speed of rotation of the main drive shaft 25 has been described as being controlled by an eddy current variable speed clutch 24, it is to be understood that other types of variable speed drives can be used or various types of variable speed motors may be used. For example, a direct current variable speed motor can be directly connected to the main drive shaft 25. Also, an alternating current variable frequency motor may be directly connected to the main drive shaft 25.

The master computer 100 is preferably provided with various programs including the proper optimum speed curve for various types of strand material which may be wound on the strand supply carriers 85. With this information in the master computer 100, it is merely necessary for the operator to set the master computer in accordance with the type of strand material wound on the strand supply carriers 85 and the speed curve programmed into the master computer 100 will then automatically increase the speed of travel of the first and second sets of strand supply carrier shuttles 55A, 55B in response to a decrease in the amount of strand material wound on the strand supply carriers 85.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a braiding machine having first and second sets of strand supply carrier shuttles, a strand supply carrier mounted on each of said shuttles and containing strand material wound thereon and adapted to be unwound therefrom during the braiding operation, a set of drive rotors rotatably supported in a circular arrangement around a central braiding location and supporting said first and second sets of strand supply carrier shuttles thereon, and drive means for imparting rotation to adjacent ones of said drive rotors in opposite directions and for imparting movement to said first and second sets of strand supply carrier shuttles in serpentine intersecting paths of travel and in opposite directions around the central braiding location, the combination therewith of speed control means for progressively increasing the speed of travel of said first and second sets of strand supply carrier shuttles in response to the amount of strand material wound on said supply carriers being decreased and to thereby increase the efficiency of said braiding machine.

2. In a braiding machine according to claim 1 wherein said speed control means comprises (a) sensor means supported adjacent the path of travel of said strand supply carrier shuttles and being operable to detect the amount of strand material remaining on said strand supply carriers during selected serpentine paths of travel of said first and second sets of strand supply carrier shuttles during the braiding operation, and (b) control means operative by said sensor means and being operable to progressively increase the speed of travel of said first and second sets of strand supply carrier shuttles in response to a detected decrease in the amount of strand material wound on said strand supply carriers.

3. In a braiding machine according to claim 2 wherein said sensor means includes a first ultrasonic sensor device supported adjacent the path of travel of said first set of said strand supply carrier shuttles, and a second sensor device supported adjacent the path of travel of said second set of strand supply carrier shuttles.

4. In a braiding machine according to claim 3 including respective first and second proximity switches operatively connected to said first and second sensor devices and being operable to trigger said first and second sensing devices in response to movement of said strand supply carrier shuttles into position for detecting the amount of strand material remaining thereon.

5. In a braiding machine according to claim 2 wherein said drive means includes a variable speed drive device, and wherein said control means is operative to progressively increase the speed of said variable speed drive and the speed of travel of said first and second sets of strand supply carrier shuttles in response to a detected decrease in the amount of strand material wound on said strand supply carrier shuttles.

6. In a braiding machine according to claim 2 wherein said control means includes computer means for receiving information from said sensor means indicating the amount of strand material wound on said strand supply carriers, and for progressively increasing the speed of travel of said first and second sets of strand supply carrier shuttles in response to an indication that the amount of strand material on said strand supply carriers is decreased.

7. In a braiding machine according to claim 6 wherein said braiding machine includes multiple braiding decks, said drive means includes a drive motor and a variable speed drive associated therewith, and a main drive shaft drivingly connected to each of said braiding decks, and wherein said computer means is operatively connected to said variable speed drive for progressively increasing the speed of rotation of said main drive shaft in response to a detected decrease in the amount of strand material on said strand supply carriers.

8. In a braiding machine according to claim 7 wherein said computer means includes a minicomputer associated with each of said braiding decks, and a main computer connected to said minicomputers and being connected to said variable speed drive.

9. In a braiding machine according to claim 7 including a braided material haul-off for withdrawing the braided material from said braiding machine, wherein said drive motor and said variable speed drive are drivingly connected to said braided material haul-off, and wherein said computer means progressively increases the speed of said braided material haul-off at the same rate as the increase in the speed of rotation of said main drive shaft.

10. A method of operating a braiding machine including a set of strand supply carrier shuttles traveling around a central braiding location, and a strand supply carrier mounted on each of said strand supply carrier shuttles and containing a full supply of strand material wound thereon and being unwound therefrom during the braiding operation, said method comprising the steps of (a) initially operating the braiding machine at a maximum speed in accordance with the type and amount of strand material wound on the full strand supply carriers, and (b) progressively increasing the speed of travel of said set of starnd supply carrier shuttles traveling around the central braiding location in direct relationship to the progressive decrease in the amount of strand material remaining on the strand supply carriers as the strand material is unwound therefrom during the braiding operation.

11. A method of operating a braiding machine at the optimum speed, the machine including a set of strand supply carrier shuttles traveling around a central braiding location, and a strand supply carrier mounted on each of said strand supply carrier shuttles and initially containing a full supply of strand material wound thereon and being unwound therefrom during the braiding operation, said method comprising the steps of (a) initially operating the braiding machine at an optimum speed in accordance with the type and amount of strand material wound on the full strand supply carriers, (b) sensing the decreasing size of the supply of strand material during continued operation of the braiding machine, (c) comparing the sensed size of the supply of strand material with the optimum speed of the machine with strand material of the sensed size, and (d) increasing the speed of operation of the braiding machine in accordance with the sensed size decrease of the supply of strand material to maintain the optimum operating speed of the braiding machine.

12. A method according to claim 11 including the step of triggering the sensing of the decreasing size of the supply strand material at a predetermined location in the path of travel of the strand supply carrier shuttles around the central braiding location.

13. A method according to claim 12 wherein the sensing of the decreasing size of the supply strand material is triggered during each path of movement of each of the strand supply carriers past the predetermined location.

* * * * *